US006823607B2

(12) United States Patent
Jerzembski et al.

(10) Patent No.: US 6,823,607 B2
(45) Date of Patent: Nov. 30, 2004

(54) PLANT FOR THE DRYING AND TREATMENT OF POURABLE MINERAL MATERIAL

(75) Inventors: Heinrich Emil Jerzembski, Heerlen (NL); Jan Bot, Avenhorn (NL)

(73) Assignee: Enerco BV, Buchten (NL)

( * ) Notice: Subject to any disclaimer, the term of this patent is extended or adjusted under 35 U.S.C. 154(b) by 0 days.

(21) Appl. No.: 10/650,235

(22) Filed: Aug. 28, 2003

(65) Prior Publication Data

US 2004/0118006 A1 Jun. 24, 2004

(30) Foreign Application Priority Data

Aug. 31, 2002 (DE) ..... 102 40 249

(51) Int. Cl.[7] ..... F26B 11/02
(52) U.S. Cl. ..... 34/135; 34/139; 34/141
(58) Field of Search ..... 34/396, 508, 518, 34/135, 139, 141; 432/33, 88, 1; 110/346, 229

(56) References Cited

U.S. PATENT DOCUMENTS

| | | | | |
|---|---|---|---|---|
| 3,815,257 A | * | 6/1974 | Freze | 34/129 |
| 4,138,620 A | | 2/1979 | Dickson | 313/1 |
| 4,189,300 A | | 2/1980 | Butler | 432/118 |
| 4,286,944 A | | 9/1981 | Labriot et al. | 432/14 |
| 4,318,620 A | | 3/1982 | Malipier et al. | 366/25 |
| 4,354,826 A | | 10/1982 | Krueger et al. | 432/18 |
| 5,555,823 A | * | 9/1996 | Davenport | 110/346 |
| 5,634,281 A | * | 6/1997 | Nugent | 34/207 |
| 5,658,603 A | * | 8/1997 | Andersen et al. | 425/532 |
| 6,219,937 B1 | * | 4/2001 | Culp et al. | 34/396 |

FOREIGN PATENT DOCUMENTS

| | | |
|---|---|---|
| BE | 858730 | 1/1978 |
| DE | 3110380 | 9/1982 |
| DE | 3815104 | 11/1989 |
| DE | 2946991 | 10/1992 |
| DE | 42432264 | 6/1994 |
| EP | 0030403 | 6/1981 |
| EP | 0032468 | 7/1981 |
| FR | 1116508 | 5/1956 |
| FR | 7832452 | 6/1980 |
| GB | 872269 | 7/1961 |

* cited by examiner

*Primary Examiner*—Stephen Gravini
(74) *Attorney, Agent, or Firm*—Davidson, Davidson & Kappel, LLC

(57) ABSTRACT

A plant for the drying and treatment of a pourable mineral material. The plant includes a combustion apparatus, introducing smoke gases into a rotary-driven rotary drum for cocurrently with the pourable mineral material. The rotary drum is inclined in the conveying direction, has installed fittings on the inner circumference and is connected sealingly at its outlet end to a shaft. The installed fittings in a front introduction region of the drum are transport blades. The shaft is put under a vacuum by means of a fan and is set up to take over the material and gas stream emerging from the rotary drum. A Venturi fitting is arranged coaxially in the rotary drum, upstream of the outlet, and a bypass for conveying air is arranged in the drum casing in the introduction region.

10 Claims, 2 Drawing Sheets

PLANT FOR THE DRYING AND TREATMENT OF POURABLE MINERAL MATERIAL

Priority is claimed to German Patent Application No. DE 102 40 249.3, filed Aug. 31, 2002, the entire disclosure of which is incorporated by reference herein.

BACKGROUND

The present invention relates to a plant for the drying and treatment of a pourable mineral material, such as, for example, coal. Mineral material, when being extracted and treated, occurs usually in the form of a mixture of fragmentary or granular material and finest-grained and pulverulent material. So that this mixture can be separated into predetermined fractions, for example fragments, coarse-grained, finest-grained and pulverulent material, first the fraction above a predetermined grain diameter is separated as fragmentary material by screening. So that the coarse-grained fraction can be further separated from the finest-grained and pulverulent fraction from passage through the screen, the screen passage must first be dried. Rotary drums have proved appropriate as an assembly for the drying of mineral mixtures.

Rotary drums for the drying of moist mineral material are typically drums which are inclined in the conveying direction of the material to be dried and through which hot smoke gases from a combustion plant are introduced either in countercurrent or in cocurrent to the material to be dried. Such plants are operated in cocurrent when the freshly fed moist material is to be brought into contact with the freshly introduced hot smoke gases in order to achieve rapid drying success, while the countercurrent method is employed, for example, when the already predried material is to be brought into contact with the hot smoke gas in the state of maximum drying capacity in order to expel the last moisture residues.

Plants of the type described are also referred to as rotary tubular kilns. A rotary tubular kiln operated in countercurrent is described in German Patent Document DE 42 43 264 A1. Further rotary kilns are described, for example, in European Patent Document EP 0 032 468 A, French Patent Documents FR 2 441 682 A and FR 1 116 508, U.S. Pat. No. 4,189,300, European Patent Document EP 0 030 403 A, Belgian Patent Document BE 858 730, and German Patent Documents DE 31 10 380 A1 and DE 38 15 104 A1.

A rotary tubular kiln, which is operated in cocurrent is known from U.S. Pat. No. 4,318,620.

Completely different aims in the treatment of the material during drying may be pursued with regard to the various types of mineral materials. If the mineral material is to be dried as far as possible without further abrasion and destruction, the material is treated carefully and protectively in the rotary drum. If, however, a mixture consists of hard dimensionally stable grains and of soft grains tending to disintegrate, stabilization can be achieved, during drying, in that the grains, while being dried and while traveling through the rotary drum, are deliberately subjected to harsh treatment, with the aim of destroying the softer grains, so that these occur as finest-grained or pulverulent material.

SUMMARY OF THE INVENTION

An object of the present invention is to provide a plant for the drying and treatment of pourable mineral material, in which stabilization intensity is high and good environmental compatibility is afforded.

The present invention provides a plant for the drying and treatment of pourable mineral material, that includes a rotary drum (1) inclined in the conveying direction of the material to be treated and provided with installed fittings (3, 4, 5) on the inner circumference, transport blades (3) being arranged as installed fittings in the front introduction region for the material to be treated, and the outlet end of the rotary drum (1) being connected sealingly to a shaft (6) which takes over the material emerging from the rotary drum (1) and the gas stream. The plant also includes a combustion apparatus (2), the smoke gases of which can be led through the rotary drum (1) in cocurrent with the material to be treated, a fan (7) which puts the shaft (6) under a vacuum, and a Venturi fitting (8) which is arranged coaxially in the rotary drum (1) upstream of the outlet end of the latter. A bypass (9) for conveying air is arranged in the drum casing in the introduction region of the material to be treated.

The plant according to the invention has the advantage that the fed moist mixture is brought into contact, immediately when being fed into the rotary drum, with the fresh hot smoke gases not yet cooled and is heated in a shock-like manner. As a result, the soft grains, which preferentially absorb water, disintegrate by decrepitation. The material to be dried, when it passes further on through the rotary drum, is lifted into a position in the upper region of the rotary drum by the installed fittings, so as then to fall downward in the drum over as long a distance as possible, further stabilization occurring. The smoke gas stream sucked in the conveying direction forms a strong flow, which picks up and carries along the pulverulent and finest-grained constituents. The flow velocity is increased by means of the Venturi fitting. The bypass for conveying air in the drum casing ensures that, in the event of a relatively high vacuum in the drum, additional conveying air is sucked in from the surroundings, without the air/fuel mixture in the combustion plant and consequently optimum combustion being disturbed by this additional conveying air, with the result that additional $NO_x$ formation is also very substantially avoided.

By a fan of variable rotational speed being used, it is advantageously possible to influence the suction and consequently the vacuum in the drum. The stabilization intensity can thereby also be influenced. Since the gas streams sucked through the Venturi fitting are dust-laden, the fact that the guide surfaces are formed only partially has the effect that no materials are accumulated or build up in the Venturi fitting, the result of this being that the flow resistance in the drum would increase.

If the inlet end of the drum is connected sealingly to the combustion apparatus, the intake of fresh air, which is not preheated is avoided. Since the bypass orifice in the drum casing is arranged only at a distance downstream of the inlet end, this has the effect that the ambient air sucked in directly at the inlet end is preheated when it flows through the annular gap between the drum casing and the double casing, so that the heating is utilized to assist the drying and the drying is not adversely influenced by the intake of cool ambient air which is not preheated. The thermal insulation of the double casing and of the circumferential boxes has the effect that the heat radiated out of the drum becomes active in the preheating of the bypass gas and is not lost due to radiation into the surroundings.

The design of the installed fittings alternately as straight plates and as plates bent in the longitudinal direction so as to form pockets has the effect of intermixing the material to be dried and of lifting the material to be dried into the uppermost regions of the drum volume during the rotation of the drum. The fact that a stop wheel rotatably mounted at a fixed location is arranged in such a way that at least one circumferential ring rolls against it advantageously prevents the rotary drum from being moved in the direction of inclination. The formation of the upwardly directed gas stream in the shaft leads to wind sifting of the discharged material in such a way that the granular material falls downward counter to the gas stream, while the finest-grained and pulverulent material, together with the gas stream, is led upward to the device for transfer into a dedusting plant.

BRIEF DESCRIPTION OF THE DRAWINGS

The features and advantages described are clearly illustrated in the description of an exemplary embodiment illustrated in the accompanying drawing in which.

DETAILED DESCRIPTION OF THE PREFERRED EMBODIMENTS

Figure 1:
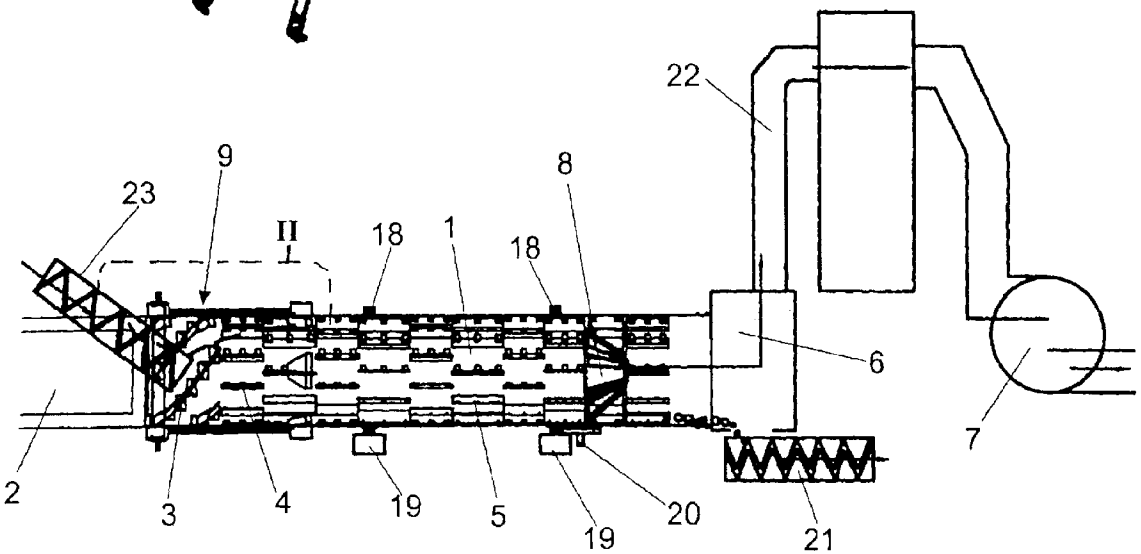
FIG. 1 shows a diagrammatic side view of a rotary drum.

FIG. 1 illustrates a side view in sectional form of the rotary drum 1. A combustion apparatus 2 is illustrated diagrammatically on the left of the rotary drum 1 in the illustration. The smoke gas stream from the combustion apparatus flows into the inlet side of the rotary drum, which smoke gas stream is illustrated by a large arrow in the direction of flow, leaves the rotary drum 1 on the outlet side into the shaft 6 and is led upward there to the transfer device 22 which leads to a dedusting plant. Downstream of the transfer device 22 is arranged a fan 7 which ensures an appropriate vacuum and suction in the rotary drum 1 and in the shaft 6. The material to be dried is fed into the rotary drum 1 by means of the feed device 23 in cocurrent with the smoke gas stream. Installed fittings designed as transport blades 3 on the drum casing are arranged at the feed end of the rotary drum 1 in the region which is illustrated by hatching in the drawing. The obliquely installed transport blades 3 have a curvature with a component acting strongly in the conveying direction.

The transport blades 3 are followed by blade fittings which are arranged one behind the other in rows and have alternately straight plates 4 and plates 5 bent in the longitudinal direction so as to form pockets. The straight plates 4 cause the material to be dried to be intermixed. The bent plates 5, in a position in the lower drum region, pick up the material to be dried and, during the rotation of the rotary drum 1, lift said material virtually through 180° into the uppermost drum region, from where the material to be dried falls downward over a great height.

The vacuum generated with the aid of the fan 7 gives rise, in the rotary drum, to a gas stream which comprises essentially the smoke gases from the combustion apparatus 2. This gas stream is led through the coaxial Venturi fitting 8, with the result that the flow velocity is increased. Finest-grained and pulverulent particles are intercepted by the gas stream and discharged into the shaft 6. The fragmentary and granular dried material is also discharged into the shaft at the discharge end of the rotary drum 1. Since a vertical flow is formed in the shaft 6, this flow acts in the same way as a wind sifter and with it leads the finest-grained and pulverulent fractions of the dried material upward to the transfer device 22, from where the gas stream laden with pulverulent and finest-grained material is led to a following dedusting plant.

The rotary drum is inclined at an angle $\alpha$ in the conveying direction and has two circumferential rings 18 which are spaced apart in the longitudinal direction and on which the rotary drive 19 engages. The rear circumferential ring 18 in the conveying direction rolls against a stop wheel 20 which is mounted rotatably to a fixed location, thus preventing the rotary drum from being moved axially in the conveying direction. The feed device 23 and the discharge device 21 may be designed both as a band and as a worm, a worm having sealing-off advantages.

Figure 2:
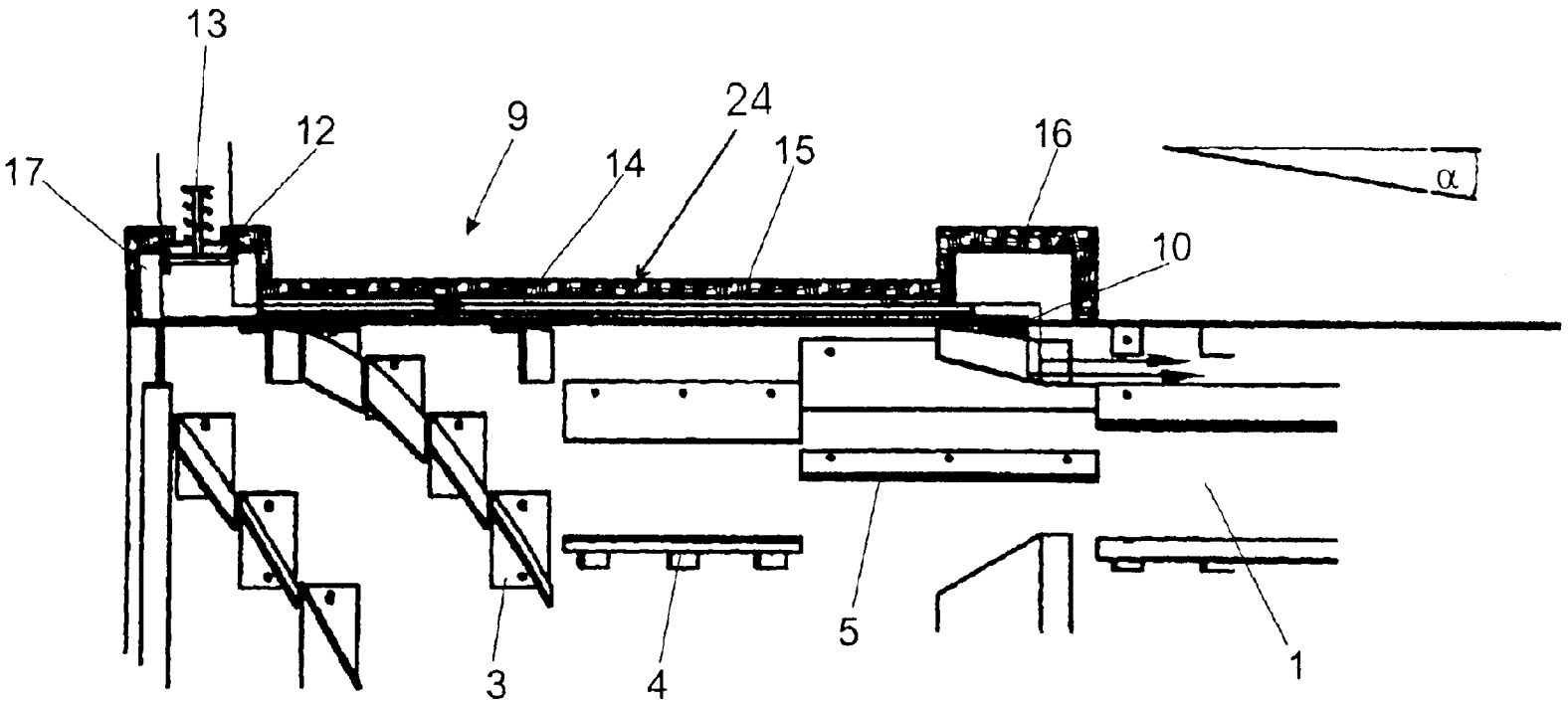
FIG. 2 shows the detail II from FIG. 1 on an enlarged scale.

FIG. 2 illustrates on an enlarged scale the detail II which is marked by a dashed and dotted line in FIG. 1 and which shows the construction of the bypass 9 in the drum casing. Arranged in the drum casing, at a distance from the feed end of the rotary drum 1, is an orifice 10 which is covered by the circumferential box 16. A plurality of the orifices 10 may be distributed over the circumference and are covered as a whole by a gas-tight annular circumferential box 16. The box 16 is connected to a second circumferential box 17 via a coaxial double casing 24, the double casing 24 forming an annular gap 14 between the drum casing and the double casing 24. At least one orifice 12 to the surroundings is likewise arranged in the second circumferential box 17 and is closed so as to seal off inwardly by means of a flap 13 prestressed outward. The two circumferential boxes 16 and 17 and the double casing 24 have a thermal insulation 15 which is illustrated by a hatched strip in the illustration.

The operation of the bypass is such that, in the event of an appropriate vacuum in the rotary drum 1 which is at least equal to or higher than the prestressing force of the flap 13, the orifice 12 is opened by suction being exerted on the flap 13, in such a way that ambient air is sucked in and, as a result of heat radiation by the drum casing, is sucked, preheated, into the rotary drum. As a result, with an appropriate increase in the vacuum and consequently in the suction in the rotary drum 1, the conveying gas stream can be increased, without the fuel/combustion-air ratio of the combustion apparatus being changed as a consequence.

Figure 3:
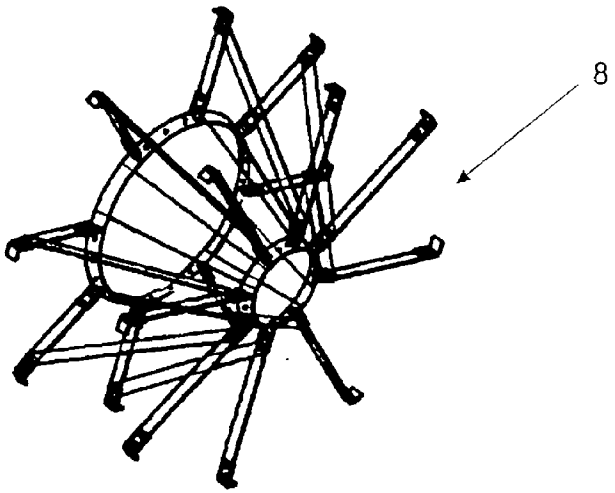
FIG. 3 shows an enlarged perspective illustration of a Venturi fitting.

FIG. 3 illustrates diagrammatically the construction of the coaxial Venturi fitting 8. In this Venturi fitting, the guide surfaces are formed only partially, so that sufficient free flow cross section remains between the guide surfaces formed. This avoids the situation where too much of the dust content of the gas stream settles on the guide surfaces formed and possibly builds up, which could otherwise lead to an undesirable increase in the flow resistance. The fraction of the guide surfaces formed is sufficient to center the gas stream and increase the flow velocity in the manner of a Venturi nozzle.

What is claimed is:

1. A plant for the drying and treatment of a pourable mineral material, comprising:

a rotary drum for conveying the pourable mineral material and including a drum casing, an introduction region, and an outlet end, the rotary drum being inclined in a conveying direction of the pourable mineral material and including a plurality of transport blades disposed in an introduction region of the drum;

a bypass disposed in the drum casing at the introduction region for conveying air;

a shaft in sealing connection with the outlet end and configured to receive the pourable mineral material from the rotary drum;

a combustion apparatus emitting smoke gases through the rotary drum cocurrently with the pourable mineral material;

a fan providing a vacuum in the shaft; and a Venturi fitting disposed coaxially in the rotary drum upstream of the outlet end.

2. The plant as recited in claim 1, wherein the fan has a variable rotational speed.

3. The plant as recited in claim 1, wherein the Venturi fitting includes guide surfaces covering only a portion of a circumference of the Venturi fitting.

4. The plant as recited in claim 1, wherein the rotary drum includes an inlet end in sealing connection with the combustion apparatus.

5. The plant as recited in claim 1, wherein the rotary drum includes an inlet end and wherein the bypass includes:

at least one first orifice formed in the drum casing at a distance downstream of the inlet end;

a plurality of second orifices formed in the drum casing and distributed over the circumference of the drum;

a first gas-tight box disposed on the drum casing over the circumference of the drum covering the plurality of second orifices;

a double casing;

a second circumferential box disposed upstream of the first gas-tight box and connected to the first gas-tight box via an annular gap between the drum casing and the double casing; and at least one third orifice disposed in the second circumferential box and communicating with an exterior of the second circumferential box, the at least one third orifice being closed using a flap prestressed in an outward direction of the at least one third orifice so as to inwardly seal off the at least one third orifice.

6. The plant as recited in claim 5, wherein the first and second circumferential boxes and the double casing include a thermal insulation toward the surroundings.

7. The plant as recited in claim 5, further comprising a plurality of second blade units disposed downstream from the transport blades and disposed on an inner circumference of the drum, each of the plurality of second blade units including a plate bent in a longitudinal direction of the drum so as to form a plurality of pockets.

8. The plant as recited in claim 5, wherein the drum includes two circumferential rings spaced apart in a longitudinal direction of the drum, a rotary drive engaging the two circumferential rings, and a stop wheel rotatably mounted at a fixed location and engaging at least one of the circumferential rings.

9. The plant as recited in claim 5, further comprising a discharge device disposed below the shaft for a granular component of the pourable mineral material and a transferring device disposed above the shaft for transferring a portion of the pourable mineral material to a dedusting plant, and wherein an upwardly directed gas stream is formed in the shaft.

10. The plant as recited in claim 9, further comprising at least one silo disposed downstream of the discharge device for granular and fragmentary components of the pourable mineral material and at least one silo disposed downstream of the dedusting plant for a dust component of the pourable mineral material.

* * * * *